United States Patent [19]

Cawte

[11] Patent Number: 5,020,435

[45] Date of Patent: Jun. 4, 1991

[54] FUZE

[75] Inventor: Daniel C. Cawte, Dysart, Australia

[73] Assignee: Meadowside Pty. Ltd., Queensland, Australia

[21] Appl. No.: 507,023

[22] Filed: Apr. 10, 1990

[51] Int. Cl.[5] ..... C06C 5/00

[52] U.S. Cl. ..... 102/275.1; 102/275.8

[58] Field of Search ..... 102/275.8, 275.6, 275.5, 102/275.1

[56] References Cited

U.S. PATENT DOCUMENTS

| | | | |
|---|---|---|---|
| 3,057,296 | 10/1962 | Silverman | 102/275.5 |
| 3,374,737 | 3/1968 | Pike | 102/275.5 |
| 3,621,558 | 11/1971 | Welsh et al. | 102/275.8 |
| 4,313,380 | 2/1982 | Martner et al. | 102/317 |
| 4,838,165 | 6/1989 | Gladden et al. | 102/275.1 |

*Primary Examiner*—David H. Brown

*Attorney, Agent, or Firm*—Hoffman, Wasson & Gitler

[57] ABSTRACT

A fuze suitable for connecting detonation initiation means to an explosive charge, such fuze having indicia thereon to indicate the length of the fuze. A method for charging a blasthole, using the unique fuze, is also disclosed.

5 Claims, 1 Drawing Sheet

Fig. 1.
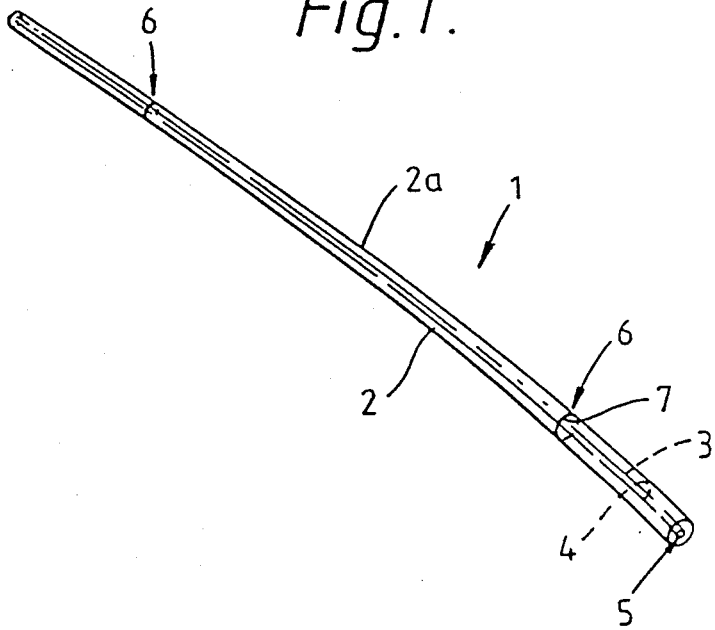
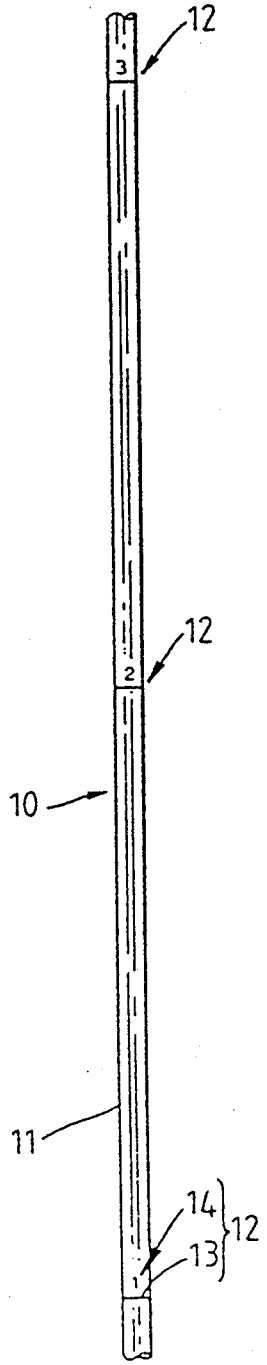
Fig. 2.

FUZE

This invention relates to an improved fuze suitable for use in explosive blasting in open cut mining, although the invention is not limited to such use.

Throughout the specification, the term "fuze" is intended to include all elongated energy transmission media suitable for connecting a detonation initiator to an explosive charge, e.g., detonating cord or ribbon, lead wires for electric detonators, optical fibre detonators, and detonation-transferring ducts, tubes or hoses, such as NONEL (trade mark) tube.

In open cut mining, a number of blastholes are drilled (typically to a depth of many meters), filled to a desired level with explosive, and the explosive charges in the individual blastholes are then detonated, via respective fuzes connected to a central detonation initiator, in a predetermined timing sequence in order to achieve maximum efficiency in breaking up the earth to be removed. The blastholes are drilled or dug at predetermined locations to specified depths. To obtain maximum blast efficiency, each blasthole must be charged with the correct quantity of explosive, and the charge should not extend above a predetermined distance below the top of the hole, (known as the "collar").

To satisfy these criteria, the shotfirer must know the depth of the blasthole before the explosive charge is loaded into the blasthole. If the shotfirer assumes that the depth of the blasthole is the same as when the hole was drilled, this can be an incorrect assumption. The blastholes may often be charged with explosive some days, weeks or months after drilling, and the depth of the charge holes may have changed in the interim period, e.g. due to backfilling by drill cuttings at the surface. Alternatively, the blasthole may not have been drilled to the specified depth initially.

If too little explosive is used, there will be insufficient explosive energy to break up or loosen the earth to the desired degree and/or to the desired depth. On the other hand, if too much explosive is used, costs are increased unnecessarily due to wastage, and the fragmentation depth may be deeper than desired. Moreover, excessive flyrock may be generated at the top of the blasthole, with increased likelihood of damage to nearby structures and/or injury to personnel in the area.

For example, if the blasthole is designed to be charged to a 5 meter "collar", but the depth of the hole is actually 3.5 meters shallower than designed, e.g. due to insufficient drilling depth initially and/or subsequent backfilling of the hole, then the predetermined quantity of charge will leave only a 1.5 meter collar. In a standard 270mm diameter blasthole using ANFO (ammonium nitrate and fuel oil mix) explosive of 0.85 gms/cubic cm. density, this inaccuracy results in an extra 170kg of explosive being used ineffectively or unnecessarily. Furthermore, the overloaded blasthole will pose safety problems and perform less efficiently as mentioned above.

To date, in order to obtain an accurate indication of the current depth of the blasthole, it has been necessary to measure the blasthole immediately prior to loading of the explosive charge, e.g. by feeding a tape measure into the hole and noting the depth. This is a time consuming procedure and increases the costs of blasting.

It is an object of this invention to overcome or at least ameliorate the abovedescribed disadvantages of the prior art, by providing an improved fuze, as well as a method of using the improved fuze in blasthole firing.

In one broad form,. the present invention provides an improved fuze for connecting a detonation initiator to an explosive charge, said fuze having indicia thereon to indicate fuze length.

The indicia may suitably comprise markings at predetermined intervals along the fuze, e.g. a marking every meter length of fuze.

Preferably, the indicia comprise numerals at predetermined intervals (e.g. meter lengths) indicating the length of the fuze in the desired units of measurement. The numerals may suitably be arranged in increasing order from one end of the fuze to the other. Alternatively the numerals may be arranged in repeating sequences of a preselected length, e.g. the length of the fuze may be indicated by numerals up to, say, 30 meters, with the sequence of length indicating numerals being repeated every 30 meters.

The length indicia can be marked on the external surface of the fuze during the manufacturing process, or applied subsequently.

The fuze may be any suitable known fuze such as electric detonator lead wire, detonating cord such as that described in U.S. Pat. No. 3,125,024 or detonation transmitting duct or hose such as that described in U.S. Pat. No. 3,590,739. The preferred form of fuze is the NONEL (trade mark) detonating tube. This is a thin, tough plastic tube with a thin coating of reactive material on the inner surface of the tube. When initiated, the tube will transmit a low energy signal from one point to another by means of a shock wave phenomena akin to a dust explosion. The detonation will propagate around bends and through kinks of the NONEL tube. As the detonation is sustained by a small quantity of reactive material, the outer surface of the tube remains intact during and after functioning. The NONEL tube is normally provided in discreet lengths. The indicia can be applied to the plastic NONEL tube simply and economically during manufacture, e.g. by inking.

According to another aspect of the invention, there is provided a method of charging a blasthole, said method including the steps of:

introducing the improved fuze described above lengthwise into said blasthole such that the distal end of the fuze is located adjacent the bottom of the blasthole, noting the depth of the blasthole from the indicia on the fuze, and charging the blasthole with explosive charge at a predetermined depth.

When inserting the fuze, the shotfirer can concurrently check that the blasthole is of the correct depth. If the actual depth differs form the design depth, the shotfirer can adjust the charge accordingly. (Of course, if there is a major difference, the hole may be redrilled).

By using the improved fuze of this invention, the charging time, and hence cost, can be minimized since the blasthole measurement and charging are achieved in a single operation. That is, it is no longer necessary to measure the blastholes beforehand with a tape measure since the depth of the blasthole will be indicated by the fuze when placed in the blasthole.

As a result, more accurate loading of the blasthole can be achieved since the depth of the hole at the time of charging is known. Improved blast efficiency will be achieved as a result of the more accurate loading of the blasthole. Accurate loading of the blasthole will also result in improved safety since flyrock will be minimized when holes are charged to the designed collar.

In order that the invention may be more fully understood and put into practice, preferred embodiments thereof will now be described by way of example with reference to the accompanying drawings, in which FIG. 1 is a perspective view of an improved fuze according to a first embodiment of the invention, and FIG. 2 is an elevational view of an improved fuze according to another embodiment of the invention. As shown in FIG. 1, the improved fuze 1 of a first embodiment of this invention comprises a length of NONEL tubing formed by a hollow plastic tube 2 having an internal gas bore 3. The internal surface 4 of the tube 2 is lined with reactive material 5. When the reactive material is detonated, the detonation will be sustained and propagated through the tube by means of a shock wave phenomena in a known manner (see U.S. Pat. No. 3,590,739).

Indicia are provided on the outside surface of the tube 2 to indicate length. In the illustrated embodiment, the indicia are in the form of circular markings 6 round the outer surface 2*a* of the tube 2 at predetermined intervals, e.g. at meter spacings. Each circular marking 6 can be applied to the tube by any suitable known method, e.g. by inking.

The fuze 10 illustrated in FIG. 2 is similar to that of FIG. 1, but is provided with indicia 12 which comprise a circular line 13 around the tube at predetermined intervals, together with an associated numeral 14 indicating length. The numerals may be arranged in increasing order from one end of the fuze to the other, or a sequence of numerals may be repeated along the length of the tube, e.g. every 10 meters. In the latter case, an intermediate part of the tube can be used, if desired or applicable, by cutting the tube at a zero mark so that the length of the tube will then be measured from the newly cut end. This is particularly useful for short depth blastholes to minimize wastage of fuze line.

The numerals need not be printed at every marking. For example, line markings may be placed at every meter length, and the length may be marked in numerals every five meters.

The markings may also take the form of principal markings, say, every meter, with smaller markings at fractional distances between the principal markings.

Any suitable combination of markings and numerals can be used to indicate the length of the tube to the desired degree of accuracy.

The provision of length indicating indicia on the fuze of this invention serves an important function. Namely, it enables the fuze itself to be used as a tape measure to measure the depth of the blasthole in which the fuze is being used. This allows the measurement and charging of the blasthole to be achieved in a single pass operation, thereby minimizing time and cost of charging.

In use, the fuze is introduced vertically into the blasthole until the distal end of the fuze is adjacent the bottom of the blasthole. The depth of the blasthole is determined from the markings on the fuze. For example, if the fuze contained only markings at meter lengths, the depth can be ascertained by counting the number of markings as the fuze is introduced into the hole. If the tubing also contains length-indicating numerals, the depth of the hole can be simply read from the tube at the top of the hole (assuming that the zero mark was at the distal end, or if not, simply by subtracting the reading at the distal end from the reading at the top of the hole).

It will be apparent to those skilled in the art that the improved fuze of this invention enables the charging of blastholes to be performed more quickly and with greater accuracy.

The foregoing describes only some embodiments of the invention, and modifications which are obvious to those skilled in the art may be made thereto without departing from the scope of the invention as defined in the following claims. For example, the indicia may take the form of coloured markings on the fuze. Additionally, the indicia may be applied directly to the fuze by the explosive loading machine prior to the machine introducing the fuze to the blasthole.

The claims defining the invention are as follows:

1. An elongate tubular detonator fuze for propogating a gaseous percussion from a detonation intitiator to an explosive charge, characterized in that the length of the fuze is marked on the outer surface thereof.

2. A fuze as claimed in claim 1 wherein the fuze is a flexible hollow tube with a reactive substance coating the inner periphery and adapted to support a gaseous percussion wave along the length of the tube.

3. A fuze suitable for connecting detonation initiation means at an explosive charge, characterized in that the fuze has indicia thereon to indicate the length of the fuze, the indicia comprising numbers indicating the length of the fuze from one end thereof.

4. A fuze suitable for conecting detonation initiation means to an explosive charge, characterized in that the fuze has indicia thereon to indicate the length of the fuze, the indicia comprising repeating sequences of numerals at regular distance intervals along the length of the fuze, each numeral indicating distance from the beginning of its respective sequence.

5. A fuze suitable for connecting detonation initiation means to an explosive charge, characterized in that the fuze has numerical indicia thereon to indicate the length of the fuze.

* * * * *